US006019091A

United States Patent [19]

Spoolstra

[11] Patent Number: 6,019,091

[45] Date of Patent: Feb. 1, 2000

[54] CONTROL VALVE

[75] Inventor: Gregg R. Spoolstra, Byron Center, Mich.

[73] Assignee: Diesel Technology Company, Kentwood, Mich.

[21] Appl. No.: 09/133,350

[22] Filed: Aug. 13, 1998

[51] Int. Cl.[7] ..... F02M 37/04

[52] U.S. Cl. ..... 123/496; 123/446

[58] Field of Search ..... 123/496, 506, 123/446, 299, 300; 239/533.4, 533.1

[56] References Cited

U.S. PATENT DOCUMENTS

| | | | |
|---|---|---|---|
| 4,730,585 | 3/1988 | Abe et al. . | |
| 5,025,768 | 6/1991 | Eckert | 123/496 |
| 5,345,916 | 9/1994 | Amann et al. . | |
| 5,423,484 | 6/1995 | Zuo . | |
| 5,425,341 | 6/1995 | Connolly et al. . | |
| 5,494,219 | 2/1996 | Maley et al. . | |
| 5,517,972 | 5/1996 | Stockner . | |
| 5,566,660 | 10/1996 | Camplin et al. . | |
| 5,619,969 | 4/1997 | Liu et al. . | |
| 5,632,444 | 5/1997 | Camplin et al. . | |
| 5,647,536 | 7/1997 | Yen et al. . | |
| 5,662,087 | 9/1997 | McCandless . | |
| 5,685,490 | 11/1997 | Ausman et al. . | |
| 5,694,903 | 12/1997 | Ganser | 123/496 |
| 5,706,778 | 1/1998 | Kapus . | |
| 5,709,341 | 1/1998 | Graves . | |
| 5,711,277 | 1/1998 | Fuseya | 123/496 |
| 5,730,104 | 3/1998 | Hafner . | |
| 5,738,075 | 4/1998 | Chen et al. | 123/446 |
| 5,752,659 | 5/1998 | Moncelle . | |
| 5,765,755 | 6/1998 | Peters et al. . | |
| 5,769,319 | 6/1998 | Yen et al. . | |
| 5,860,597 | 1/1999 | Tarr . | |
| 5,868,317 | 2/1999 | English . | |

FOREIGN PATENT DOCUMENTS 803 648 A1 10/1997 European Pat. Off. .

*Primary Examiner*—Thomas N. Moulis
*Attorney, Agent, or Firm*—Brooks & Kushman P.C.

[57] ABSTRACT

Pumps and injectors having a control valve with an adjustable stroke for rate shaping and associated methods for operating a control valve are provided. The pump or injector comprises a body with a pumping chamber and a control valve chamber. A plunger is disposed in the pumping chamber. An actuatable control valve disposed in the control valve chamber controls fuel. The control valve includes a valve body moveable over an adjustable stroke range including opened and closed positions. The stroke range is adjustable to vary an effective open gap when the valve body is in the open position. An actuatable valve stop assembly adjacent to the control valve chamber includes a main body and a stop member that is moveable between extended and retracted positions. The stop member limits the stroke range such that the control valve has a first effective open gap when the stop member is in the extended position, and such that the control valve has a second effective open gap when the stop member is in the retracted position. A first armature and first stator assembly operate to actuate the control valve. A second armature and second stator assembly operate to actuate the valve stop assembly.

17 Claims, 5 Drawing Sheets

CONTROL VALVE

TECHNICAL FIELD

This invention relates to a control valve for use in a heavy duty truck diesel fuel injection system.

BACKGROUND ART

Engine exhaust emission regulations are becoming increasingly restrictive. One way to meet emission standards is to rate shape the quantity and timing of the fuel injected into the combustion chamber to match the engine cycle. Effective rate shaping may result in reduced levels of particulate and oxides of nitrogen in the engine exhaust. Further, effective rate shaping that injects fuel slower during the early phase of the combustion process results in less engine noise.

Existing rate shaping techniques attempt to control injection rates by making various modifications to the injector nozzle assembly. Although these existing rate shaping techniques have been employed in many applications that have been commercially successful, there is a need for a rate shaping technique that allows more precise rate shaping than the existing modified injector nozzle assemblies.

DISCLOSURE OF INVENTION

It is, therefore, an object of the present invention to provide pumps and injectors having a control valve capable of shaping the injection rate.

It is another object of the present invention to provide a method for operating a control valve with an adjustable stroke for rate shaping.

In carrying out at least one of the above objects, a pump for a fuel injection system is provided. The pump comprises a pump body having a pumping chamber, a fuel inlet for supplying fuel to the pumping chamber, an outlet port, and a control valve chamber between the pumping chamber and the outlet port. The pump further comprises a plunger disposed in the pumping chamber, and an actuatable control valve disposed in the control valve chamber for controlling fuel. The control valve includes a valve body moveable over an adjustable stroke between open and closed positions. The stroke range is adjustable to vary an effective open gap when the valve body is in the open position.

An actuatable valve stop assembly adjacent to the control valve chamber includes a moveable stop member. The stop member is moveable between extended and retracted positions. The stop member limits the stroke range such that the control valve has a first effective open gap when the stop member is in the extended position, and such that the control valve has a second effective open gap when the stop member is in the retracted position.

A first armature is located at the control valve. A first stator assembly near the first armature includes a first actuator operable to actuate the control valve. A second armature is located at the stop member. A second stator near the second armature includes a second actuator operable to actuate the valve stop assembly.

In a preferred embodiment, a control valve spring biases the control valve away from the closed position. Upon actuation of the first actuator, the control valve is urged toward the closed position against the bias of the control valve spring. Further, in a preferred embodiment, a valve stop assembly spring biases the stop member toward the retracted position. Upon actuation of the second actuator, the stop member is urged toward the extended position against the bias of the valve stop assembly spring.

Still further, in a preferred embodiment, the valve stop assembly is configured such that first effective open gap for the control valve is at most about 0.03 mm. Still further, in a preferred embodiment, the valve stop assembly is configured such that the second effective open gap for the control valve is at least about 0.1 mm, or about three times the first effective open gap.

The second stator may be located within the valve stop assembly, or adjacent to the valve stop assembly, depending on the particular application.

Further, in carrying at least one of the above objects, fuel injector is provided. The fuel injector comprises an injector body having a pumping chamber and a control valve chamber, a plunger disposed in the pumping chamber, and an actuatable control valve disposed in the control valve chamber for controlling fuel. The control valve includes a valve body moveable over an adjustable stroke range between open and closed positions. The stroke range is adjustable to vary an effective open gap when the valve body is in the open position. The fuel injector further comprises an actuatable valve stop assembly adjacent to the control valve chamber. The valve stop assembly includes a stop member that is moveable between extended and retracted positions. The stop member limits the stroke range such that the control valve has a first effective open gap when the stop member is in the extended position, and such that the control valve has a second effective open gap when the stop member is in the retracted position.

Further, a first armature is located at the control valve. A first stator assembly near the first armature includes a first actuator operable to actuate the control valve. A second armature is located at the stop member. A second stator near the second armature includes a second actuator operable to actuate the valve stop assembly.

Still further, in carrying out at least one of the above objects, a method for operating a control valve with an adjustable stroke for rate shaping is provided. The method comprises fully closing the control valve to allow pressure to build up in the pumping chamber for an initial injection event. A stop member of an adjustable valve stop assembly is positioned at a rate shape position that limits the control valve stroke such that the control valve has a first effective open gap. The control valve is opened while the stop member is at the rate shape position to allow injection rate shaping. Thereafter, the control valve is fully closed to allow pressure to build up in the pumping chamber for a main injection event. Then, the stop member is positioned at a full stroke position such that the control valve has a second effective open gap that is greater than the first effective open gap. The control valve is fully opened while the stop member is at the full stroke position. If desired for an application, the initial injection event and the main injection event may form a single continuous injection event, or may be separated into pilot and main injections.

The advantages associated with embodiments of the present invention are numerous. For example, control valves made in accordance with the present invention for pumps or injectors allow effective rate shaping by controlling the pressure supplied to the pump outlet or injector nozzle assembly for a unit injector. Rate shaping at the control valve advantageously allows more precise rate shaping than some existing rate shaping techniques that attempt to rate shape with a modified injector nozzle assembly.

The above objects and other objects, features, and advantages of the present invention will be readily appreciated by one of ordinary skill in the art from the following detailed description of the best mode for carrying out the invention when taken in connection with the accompany drawings.

BEST MODE FOR CARRYING OUT THE INVENTION

Figure 1:
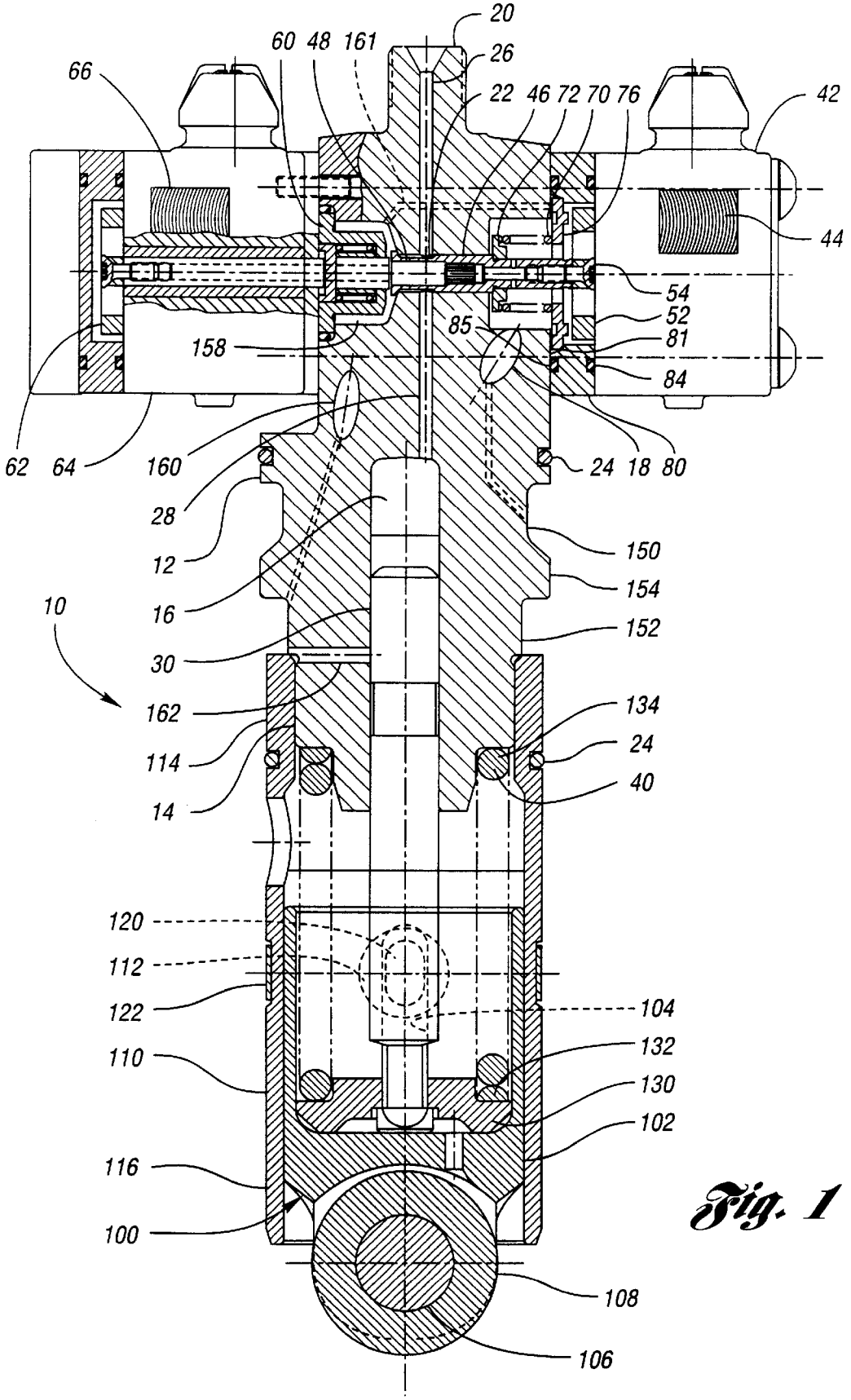
FIG. 1 is a side elevation, in section, of a pump for a fuel injection system made in accordance with the present invention.
Figure 2:
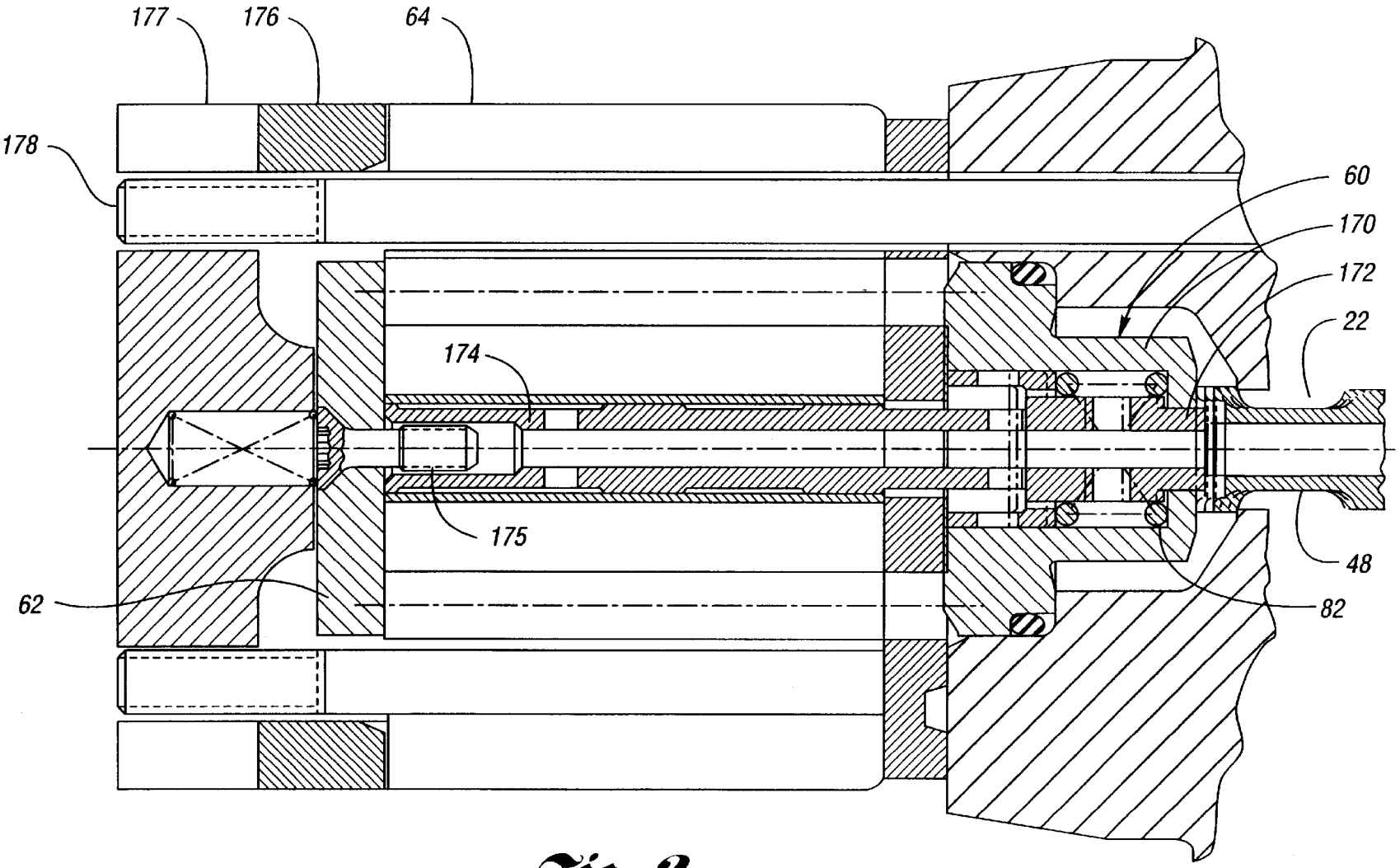
FIG. 2 is an enlarged cross-sectional view of the valve stop assembly environment on the pump shown in FIG. 1.

Referring to FIGS. 1 and 2, a pump 10 made in accordance with the present invention is illustrated. The pump 10 has a pump body 12 with a pump body end portion 14. A pumping chamber 16 is defined by pump body 12. A fuel inlet 18 supplies fuel to pumping chamber 16. Pump body 12 further has an outlet port 20, and a control valve chamber 22 between pumping chamber 16 and outlet port 20. O-rings 24 are provided to seal fuel inlet 18 with respect to an engine block which receives pump 10. Passageways 26 and 28 connect outlet port 20, control valve chamber 22, and pumping chamber 16.

A reciprocating plunger 30 is disposed in pumping chamber 16. Plunger 30 is reciprocatable over a stroke range between an extended position indicated at 30 and a compressed position (not specifically shown). A plunger spring 40 resiliently biases plunger 30 to the extended position.

A first stator assembly 42 contains an electromagnetic actuator 44, such as a solenoid, and has terminals for connecting to a power source to provide power for electromagnetic actuator 44. An electromagnetically actuated control valve 46 is disposed in control valve chamber 22 for controlling fuel. Control valve 46 includes a valve body 48. Valve body 48 is movable over an adjustable stroke range between open and closed positions as will be further described. Preferably, the open positions are deactuated positions, and the closed position is an actuated position for valve body 48. The stroke range is adjustable to vary an effective open gap when valve body 48 is in the open position.

A first armature 52 is secured to control valve 46 by a fastener such as a screw 54. An actuatable valve stop assembly 60 is disposed in pump body 12 adjacent to control valve chamber 22. Valve stop assembly 60 is connected to a second armature 62 and cooperates with a second stator 64 having actuator 66 to limit the stroke range of valve body 48, as will be further described.

A control valve spring 70 resiliently biases valve body 48 into the deactuated position, which is depicted as the open position. A control valve spring seat 72 and a control valve spring retainer 76 abut ends of control valve spring 70.

A stator spacer 80 has a central opening receiving first armature 52 therein, and is disposed between pump body 12 and stator assembly 42. Stator spacer 80 has notches 81 for receiving retainer 76. O-rings 84 and 85 seal stator spacer 80 against stator assembly 42 and pump body 12, respectively.

With continuing reference to FIG. 1, a cam follower assembly 100 is illustrated. Cam follower assembly 100 has a housing 102 with an elongated slot 104. Cam follower assembly 100 has an axle 106 and a roller 108 for engagement with a camshaft (not shown). Plunger 30 is reciprocated within pumping chamber 16 between the extended and compressed positions by cam follower assembly 100. A cylindrical sleeve 110 has an aperture 112 in communication with elongated slot 104. Cylindrical sleeve 110 has first and second end portions 114 and 116, respectively. Pump body end portion 14 interfits with first end portion 114 of cylindrical sleeve 110.

Second end portion 116 of cylindrical sleeve 110 relatively reciprocatably interfits with cam follower assembly 100 for allowing cam follower assembly 100 to drive plunger 30. Cam follower assembly 100 reciprocates within cylindrical sleeve 110 and drives plunger 30 relative to cylindrical sleeve 110 over the plunger stroke range. Preferably, a retainer guide 120 extends through aperture 112 and engages slot 104 in cam follower assembly 100. A clip 122 retains guide 120 within aperture 112.

A plunger spring seat 130 is received in housing 102 of cam follower assembly 100. Plunger spring seat 130 abuts a first end 132 of plunger spring 40. Pump body end portion 14 abuts a second end 134 of plunger spring 40.

Pump body 12 has a first annulus 150 in communication with fuel inlet 18 for supplying fuel to the pumping chamber 16. Pump body 12 further has a second annulus 152 in communication with pumping chamber 16 for receiving excess fuel therefrom. An annular belt 154 separates first and second annuli 150 and 152, respectively.

An excess fuel chamber 158 receives excess fuel from control valve chamber 22. A conventional fuel equalizing passage 161 provides fuel communication between excess fuel chamber 158 and the control valve and spring chambers such that control valve 46 is operable as a pressure balanced valve. A return passageway 160 connects excess fuel chamber 158 to second annulus 152. Another return passageway 162 connects pumping chamber 16 to second annulus 152 for receiving any fuel that leaks between plunger 30 and pump body 12. Second annulus 152 is defined by annular belt 154 and first end portion 114 of cylindrical sleeve 110. As well known in the art, fuel is supplied to pump 10 through internal fuel passageways in the engine block (not shown).

With reference again to FIGS. 1–2, and as best shown in FIG. 2, valve stop assembly 60 is adjacent to control valve chamber 22 and includes a main body 170 and a stop member 172. Stop member 172 limits the control valve stroke range. Stop member 172 is driven by a push rod 174 which is connected by a fastener, such as screw 175, to second armature 62. Second armature 62 is located within stator spacer 176. An end plate 177 is positioned against stator spacer 176, and secured by fasteners 178. One suitable way to secure first stator assembly 42 and second stator assembly 64 is with a set of long fasteners 178 extending through first stator assembly 42, pump body 12, and second stator assembly 64. Of course, other techniques may be employed to secure the stator assemblies to the pump body, as desired for any particular application. Push rod 174 pushes against one side of a stop member 172. The other side of stop member 172 engages valve stop assembly spring 182.

As shown, stop member 172 is urged to the extended position, shown in solid line, when actuated. Upon deactuation, stop member 172 is urged toward a retracted position, shown in phantom, by spring 182. That is, the position of stop member 172, or the actuation or deactuation of stator assembly 64, determines the effective open gap for control valve 46. More particularly, stop member 172 may be positioned in the retracted position when a full open gap is desired, and may be moved to the extended position when a partial or rate shape open gap is desired.

It is to be appreciated that although valve stop assembly 60 is shown with an actuated position that is the extended position, embodiments of the present invention may be configured such that the deactuated position is the extended position and the actuated position is the retracted position, for example, by locating second armature 62 on the other side of second stator 64.

With continuing reference to FIGS. 1–2, and as best shown in FIG. 2, control valve 46 is shown in the closed position in solid line. Upon deactuation, control valve 46 moves under the urging of control valve spring 70 (FIG. 1) into engagement with stop member 172. That is, upon deactuation of control valve 46, valve body 48 will open until reaching stop member 172 which may either be a full opening or partial opening of control valve 46.

Generally, fuel flows through passageway 26 and pump body 12 toward outlet port 20 in accordance with control valve 46 being opened and closed in a fixed sequence allowing the desired fuel pressure to be developed while closed. Passageway 26 is always open to the pumping chamber, but fuel flow to the nozzle is precluded, as described, and optionally with the assist of a pressure relief valve (not shown) within the high pressure line, pursuant to conventional practice.

More specifically, the opening and closing of control valve 46 in a fixed sequence to allow the desired fuel pressure to be developed while closed will be more specifically described. Fuel is received from a fuel supply by first annulus 150 and supplied to fuel inlet 18. Fuel inlet 18 routes fuel to pumping chamber 16. The cam shaft (not shown) drives cam follower assembly 100. Plunger 30 is moved from its extended position to its compressed position, and fuel is pressurized within pumping chamber 16 when control valve 46 is held closed.

In particular, control valve 46 is held closed to build up initial pressure in pumping chamber 16. Thereafter, in accordance with the present invention, control valve 46 is moved to the rate shaping position against the extended stop member 172 to allow a controlled pressure relief path. After rate shaping, control valve 46 is pulled to the fully closed position to complete the fuel injection cycle. Control valve 46 is opened to the fully open position against retracted stop member 172 once injection has completed.

It is to be appreciated that rate shaping techniques of the present invention may be employed for single injection operations and for split injection operations wherein a pilot injection is followed by a main injection.

Figure 3:
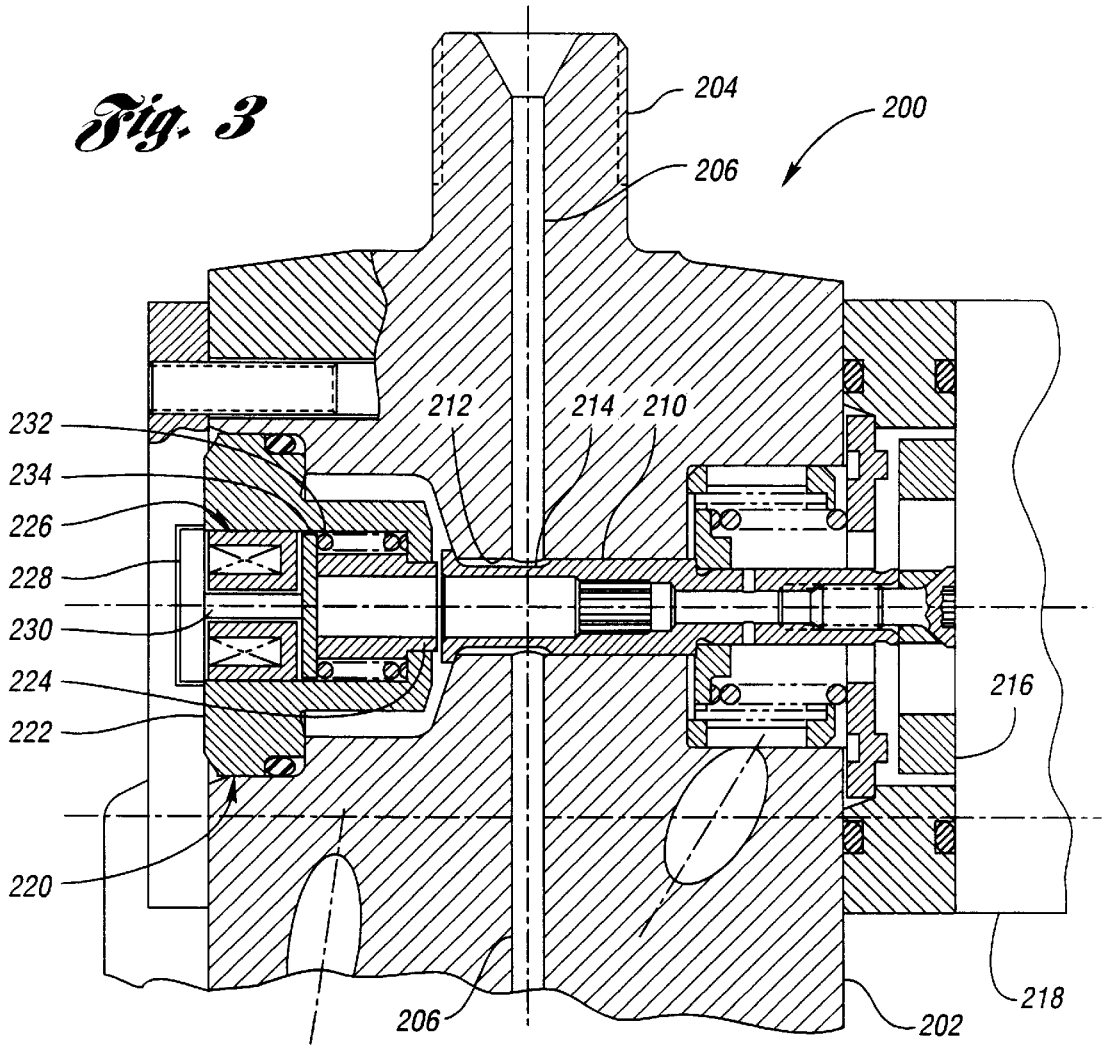
FIG. 3 is an enlarged cross-sectional view of an alternative embodiment for a control valve of the present invention, shown in a pump.

With reference to FIG. 3, an alternative embodiment of the present is illustrated. A pump 200 has a pump body 202, a pumping chamber (not specifically shown), an outlet port 204, and connecting passageways 206. A control valve 210 is disposed in a control valve chamber 212 and includes a valve body 214 moveable over an adjustable stroke range. An armature 216 is secured to control valve 210. A stator assembly 218 includes an actuator for controlling the control valve 210. As depicted, control valve 210 operates in a manner similar to control valve 46 shown in FIGS. 1 and 2.

However, in the alternative embodiment of the present invention shown in FIG. 3, an adjustable valve stop assembly 220 includes a main body 222 and a stop member 224. Stop member 224 limits the stroke range of control valve 210 such that control valve 210 has a first effective open gap when stop member 224 is extended, and such that control valve 210 has a second effective open gap when stop member 224 is retracted. Stator assembly 226 is located within valve stop assembly 220. Armature 228 connects to push rod 230 which in turn drives stop member 224.

Similar to valve stop assembly 60 (FIGS. 1–2), valve stop assembly 220 is actuated to extend stop member 224 against the bias of spring 232. Deactuation of valve stop assembly 220 allows spring 232 to move stop member 224 to the retracted position by pressing against spring seat 234.

Figure 4:
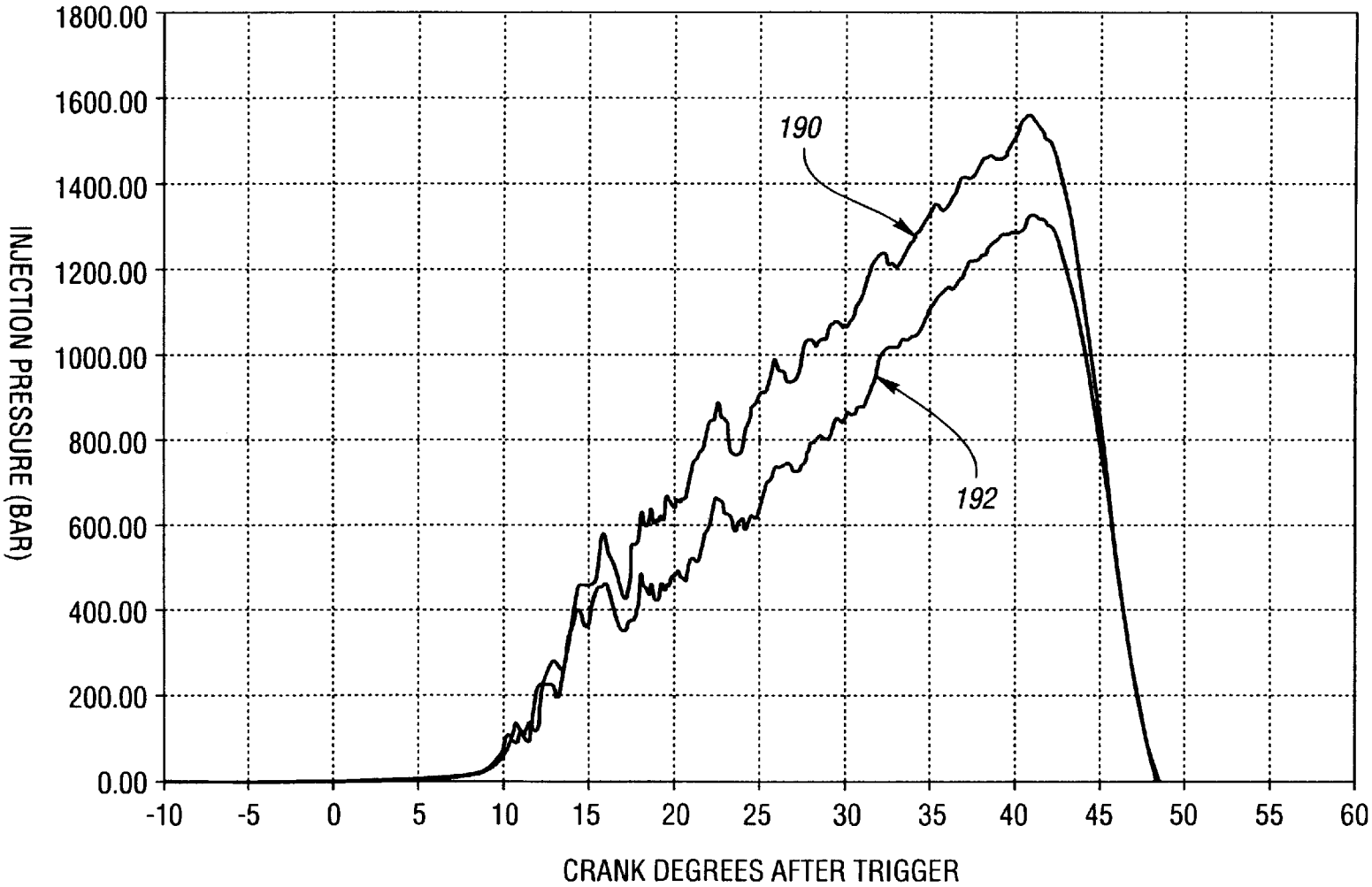
FIG. 4 is graph depicting injection pressure versus crank degrees after trigger, showing the effects of rate shaping at the control valve on the fuel injection process.

With reference to FIG. 4, a graph depicting injection pressure in bar versus crank degrees after trigger comparatively illustrates an injection cycle with rate shaping disabled and an injection cycle with rate shaping enabled. The injection cycle with rate shaping enabled is generally indicated at 192, while the injection cycle with rate shaping disabled is generally indicated at 190. The pumping rate is the same for both plot 190 and plot 192. During testing, the inventor has found that injection pressure significantly and desirably increases when rate shaping at the control valve is enabled. During initial injection, this allows higher pumping rates without emissions penalties for improved efficiency.

Figure 5:
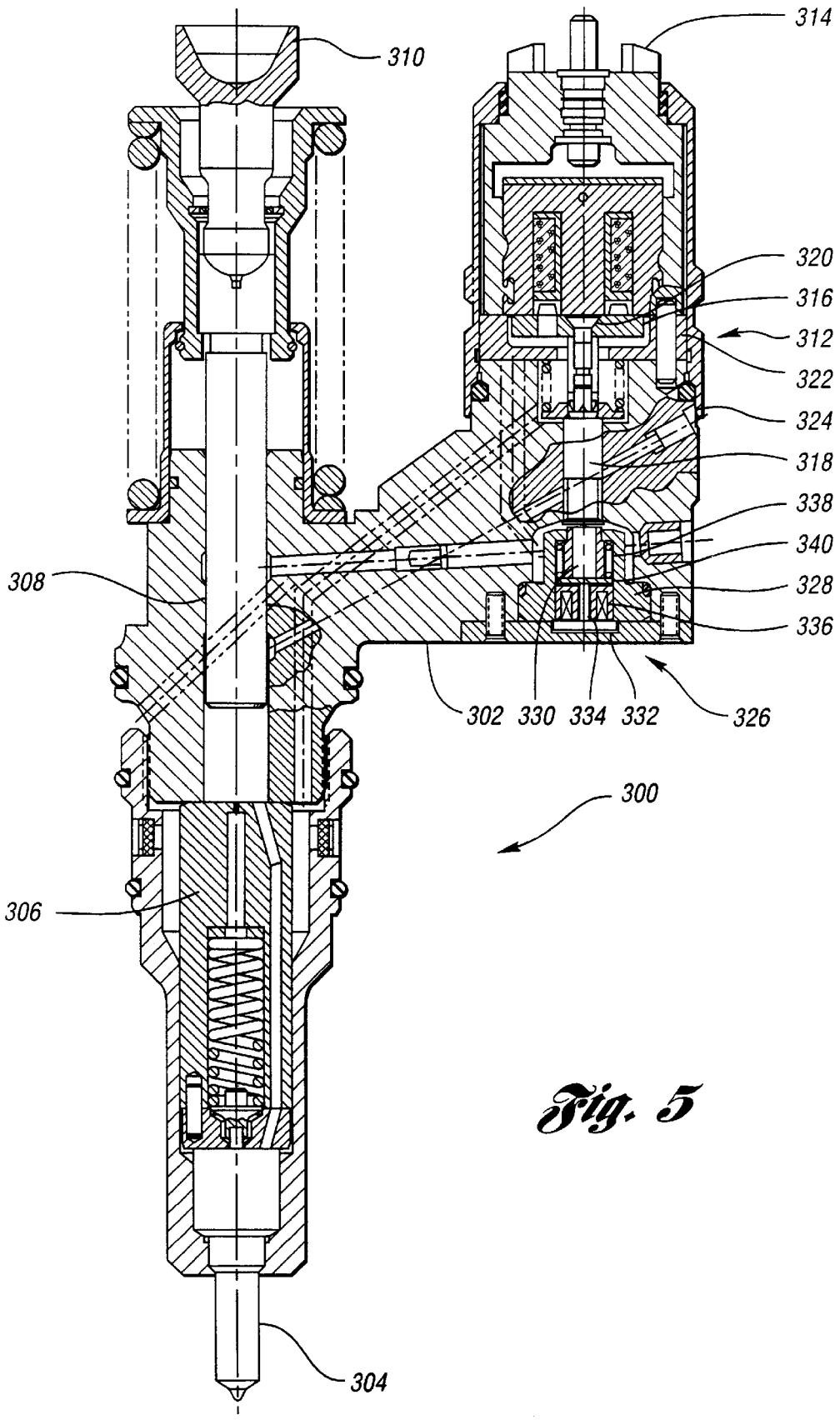
FIG. 5 is a side elevation, in section, of an injector for a fuel injection system made in accordance with the present invention.

Referring to FIG. 5, an injector 300 made in accordance with the present invention is illustrated. Injector 300 has an injector body 302 and a nozzle assembly 304. Spring cage assembly 306 is located adjacent to nozzle assembly 304. A plunger 308 is reciprocatably driven within body 302 by a push rod 310. A stator 314 includes an actuator for controlling an electronically controlled valve assembly 312. An armature 316 is secured to a control valve 318 by an armature screw 320. Armature 316 is encircled by a stator spacer 322. Control valve 318 is biased toward a deactuated position by control valve spring 324. Upon actuation, armature 316 is pulled toward stator 314 resulting in control valve 318 moving against the bias of spring 324 into the actuated position.

Injector 300 operates in a known manner, as shown, for example, in U.S. Pat. No. 4,618,095, assigned to the assignee of the present invention, and hereby incorporated by reference in its entirety. Similar to pump 10 (FIG. 1), control valve assembly 312 may be configured to either open or close upon valve actuation, based on the particular pump or injector design.

Injector 300 employs an actuatable valve stop assembly 326 made in accordance with the present invention. As shown, valve stop assembly 326 is of the compact type similar to that shown in FIG. 3. Compact type valve stop assembly 326 is preferred over the large stator version shown in FIGS. 1 and 2 because the shortened assembly may be added to the injector without requiring major modifications to the injector design.

Valve stop assembly 326 include a main body 328 and a stop member 330. An armature 332 is connected by a push rod 334 to stop member 330. Stator 336 is operable to pull armature 332 and move stop member 330 against the bias of spring 338 which abuts seat 340. That is, stop member 300 is moveable to limit the control valve stroke range to vary the effective open gap of control valve 324.

Figure 6:
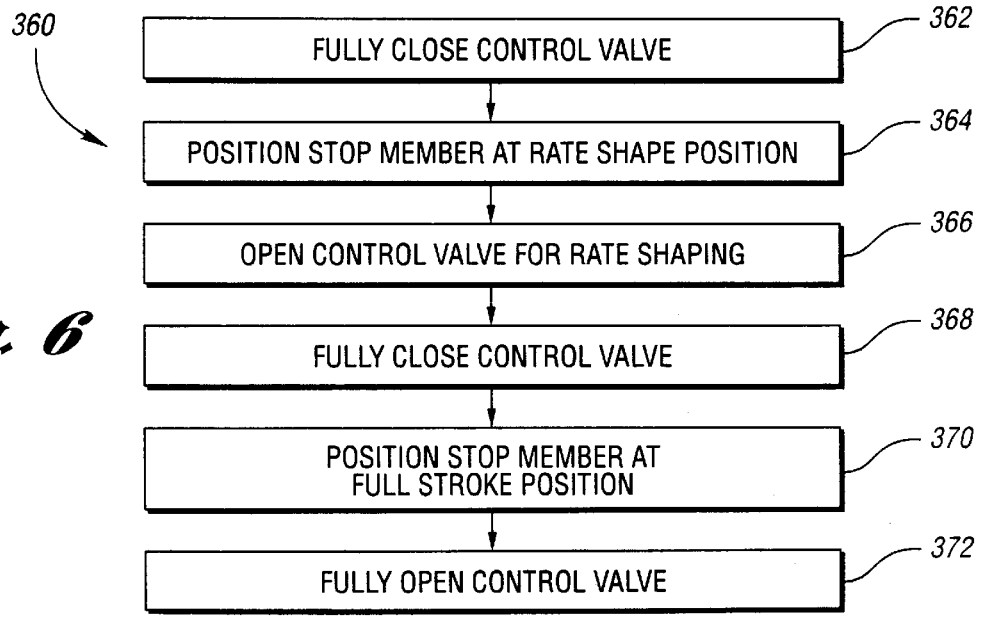
FIG. 6 is a block diagram illustrating a method of the present invention for operating a control valve with an adjustable stroke for rate shaping.

With reference to FIG. 6, a method of the present invention for operating a control valve with an adjustable stroke for rate shaping is generally indicated at 360. At block 362, the control valve is fully closed to allow pressure to build up at the pumping chamber for an initial injection event. The initial injection event may be a discrete pilot injection or may be part of a single continuous injection. At block 364, a stop member of an adjustable valve stop assembly is positioned at a rate shape position. The rate shape position, or extended position in the embodiments illustrated in FIGS. 1–3, limits the control valve stroke to allow controlled pressure relief. At block 366, the control valve is opened while the stop member is at the rate shape position.

After rate shaping, at block 368, the control valve is fully closed to allow pressure to build up in the pumping chamber for a main injection event. At block 370, the stop member of the adjustable valve stop assembly is positioned at a full stroke position, or the retracted position in the embodiments of the present invention illustrated in FIGS. 1–3. At block 372, the control valve is fully opened to end the injection cycle. It is to be appreciated that the control valve has a first effective open gap when the stop member is at the rate shape position, and that the control valve has a second effective open gap when the stop member is at the full stroke position. Further, the second effective open gap is greater than the first effective open gap.

It is believed that a suitable value for the first effective open gap for the control valve, or the rate shape open gap is preferably about 0.03 mm. However, it is to be appreciated that other values may also be suitable depending on the particular application. Further, it is believed that a suitable value for the second effective open gap for the control valve, or the full open gap, is preferably about 0.1 mm, or three times the first effective open gap. Again, it is to be appreciated that other values may be suitable depending on the particular application.

It is to be appreciated that the embodiments of the present invention illustrated in FIGS. 1–6 are preferred; however, many modifications may be made without departing from the true scope and spirit of the present invention. For example, in both pumps and injectors, the control valve may be configured to open upon actuation or close upon actuation, as desired, depending on the particular application. Further, the adjustable valve stop assembly may be configured such that actuation of the adjustable valve stop assembly produces the rate shape effective open gap while deactuation produces the full effective open gap; or, the adjustable valve stop assembly may be configured such that actuation produces the full effective open gap while deactuation produces the rate shape effective open gap. Of course, the arrangements for both the control valve and the adjustable valve stop assembly may be selected, as desired, based on the particular application for the pump or injector.

Still further, it is to be appreciated that although the preferred embodiments of the present invention illustrated herein adjust the open position seat for the control valve, it is believed that embodiments of the present invention may be constructed such that the closed position seat for the control valve is formed by the adjustable stop member. That is, the adjustable valve stop assembly varies the effective open gap for the control valve; but, the open position for the control valve may either be against the stop member or against a different stop.

For example, it may be possible to construct an inwardly opening control valve (as opposed to the outwardly opening control valves depicted in FIGS. 1–3, and 5). The inwardly opening control valve could have a fixed seat for the open position, while having an adjustable valve stop assembly with a stop member that is moveable to adjust the position of the closing seat for the control valve. As such, moving the stop member will vary the effective open gap for the control valve, even though the open position for the control valve is away from the stop member.

While the best mode for carrying out the invention has been described in detail, those familiar with the art to which this invention relates will recognize various alternative designs and embodiments for practicing the invention as defined by the following claims.

What is claimed is:

1. A pump for a fuel injection system, the pump comprising:

a pump body having a pumping chamber, a fuel inlet for supplying fuel to the pumping chamber, an outlet port, and a control valve chamber between the pumping chamber and the outlet port;

a plunger disposed in the pumping chamber;

an actuatable control valve disposed in the control valve chamber for controlling fuel, the control valve including a valve body moveable over an adjustable stroke range between open and closed positions, wherein the stroke range is adjustable to vary an effective open gap when the valve body is in the open position;

an actuatable valve stop assembly adjacent to the control valve chamber, the valve stop assembly including a stop member that is moveable between extended and retracted positions, the stop member limiting the stroke range such that the control valve has a first effective open gap when the stop member is in the extended position, and such that the control valve has a second effective open gap when the stop member is in the retracted position;

a first armature at the control valve;

a first stator assembly near the first armature and including a first actuator operable to actuate the control valve;

a second armature at the stop member; and a second stator near the second armature and including a second actuator operable to actuate the valve stop assembly.

2. The pump of claim 1 further comprising:

a control valve spring biasing the control valve away from the closed position, wherein upon actuation of the first actuator, the control valve is urged toward the closed position against the bias of the control valve spring.

3. The pump of claim 1 further comprising:

a valve stop assembly spring biasing the stop member toward the retracted position, wherein upon actuation of the second actuator, the stop member is urged toward the extended position against the bias of the valve stop assembly spring.

4. The pump of claim 1 wherein the valve stop assembly is configured such that the first effective open gap for the control valve is at most about 0.03 millimeters.

5. The pump of claim 1 wherein the valve stop assembly is configured such that the second effective open gap for the control valve is at least about 0.1 millimeters.

6. The pump of claim 1 wherein the second stator is located within the valve stop assembly.

7. A fuel injector comprising:

an injector body having a pumping chamber and a control valve chamber;

a plunger disposed in the pumping chamber;

an actuatable control valve disposed in the control valve chamber for controlling fuel, the control valve including a valve body moveable over an adjustable stroke range between open and closed positions, wherein the stroke range is adjustable to vary an effective open gap when the valve body is in the open position;

an actuatable valve stop assembly adjacent to the control valve chamber, the valve stop assembly including a stop member that is moveable between extended and retracted positions, the stop member limiting the stroke range such that the control valve has a first effective open gap when the stop member is in the extended position, and such that the control valve has a second effective open gap when the stop member is in the retracted position;

a first armature at the control valve;

a first stator assembly near the first armature and including a first actuator operable to actuate the control valve;

a second armature at the stop member; and a second stator near the second armature and including a second actuator operable to actuate the valve stop assembly.

8. The injector of claim 7 further comprising:

a control valve spring biasing the control valve away from the closed position, wherein upon actuation of the first actuator, the control valve is urged toward the closed position against the bias of the control valve spring.

9. The injector of claim 7 further comprising:

a valve stop assembly spring biasing the stop member toward the retracted position, wherein upon actuation of the second actuator, the stop member is urged toward the extended position against the bias of the valve stop assembly spring.

10. The injector of claim 7 wherein the valve stop assembly is configured such that the first effective open gap for the control valve is at most about 0.03 millimeters.

11. The injector of claim 7 wherein the valve stop assembly is configured such that the second effective open gap for the control valve is at least about 0.1 millimeters.

12. The injector of claim 7 wherein the second stator is located within the valve stop assembly.

13. A method for operating a control valve with an adjustable stroke for rate shaping, the control valve being located between a pumping chamber and an outlet, the method comprising:

fully closing the control valve to allow pressure to build up in the pumping chamber for an initial injection event;

positioning a stop member of an adjustable valve stop assembly at a rate shape position that limits the control valve stroke such that the control valve has a first effective open gap;

opening the control valve while the stop member is at the rate shape position to allow injection rate shaping;

thereafter, fully closing the control valve to allow pressure to build up in the pumping chamber for a main injection event;

positioning the stop member of the adjustable valve stop assembly at a full stroke position such that the control valve has a second effective open gap that is greater than the first effective open gap; and fully opening the control valve while the stop member is at the full stroke position.

14. The method of claim 13 wherein the initial injection event and the main injection event form a single continuous injection event.

15. The method of claim 13 wherein the first effective open gap for the control valve is at most about 0.03 millimeters.

16. The method of claim 13 wherein the second effective open gap for the control valve is at least about 0.1 millimeters.

17. The method of claim 13 wherein the initial injection event and the main injection event form separated pilot and main injections.

* * * * *